US006773771B1

(12) United States Patent
Ashida et al.

(10) Patent No.: US 6,773,771 B1
(45) Date of Patent: Aug. 10, 2004

(54) INK-JET RECORDING SHEET

(75) Inventors: Tetsuya Ashida, Tokyo (JP); Yukio Tokunaga, Tokyo (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 0 days.

(21) Appl. No.: 09/557,775

(22) Filed: Apr. 25, 2000

(30) Foreign Application Priority Data

Apr. 27, 1999 (JP) ..... 11-119054
Sep. 28, 1999 (JP) ..... 11-273689

(51) Int. Cl.[7] ..... B41M 5/00
(52) U.S. Cl. ..... 428/32.34; 428/32.25
(58) Field of Search ..... 428/32.25, 32.34, 428/195

(56) References Cited

U.S. PATENT DOCUMENTS 5,266,383 A * 11/1993 Sakaki et al. ..... 347/105
5,589,269 A * 12/1996 Ali et al. ..... 428/411.1
5,612,281 A 3/1997 Kobayashi et al.
5,948,534 A * 9/1999 Altavilla ..... 428/423.7
5,965,252 A * 10/1999 Santo et al. ..... 428/329
6,037,050 A * 3/2000 Saito et al. ..... 428/304.4
6,110,601 A * 8/2000 Shaw-Klein ..... 428/522
6,165,606 A * 12/2000 Kasahara et al. ..... 428/323
6,217,166 B1 * 4/2001 Saito et al. ..... 347/100
6,238,784 B1 * 5/2001 Mochizuki et al. ..... 428/321.1
6,335,102 B1 * 1/2002 Tsubaki et al. ..... 162/125
6,436,515 B1 * 8/2002 Ohbayashi et al. ..... 428/195

FOREIGN PATENT DOCUMENTS

EP 0 813 978 A1 12/1997
WO 99/03685 * 1/1999 ..... 428/195

* cited by examiner

*Primary Examiner*—B. Hamilton Hess
(74) *Attorney, Agent, or Firm*—Paul E. White, Jr.; Manelli Denison & Selter PLLC

(57) ABSTRACT

Disclosed is an ink-jet printing sheet which comprises a support and at least one ink-receptive layer provided on the support, wherein at least one of the ink-receptive layer contains silica fine particles having an average primary particle diameter of 20 nm or less and at least one water-soluble polyvalent metal compound.

11 Claims, No Drawings

INK-JET RECORDING SHEET

BACKGROUND OF THE INVENTION

1. Field of the Invention

This invention relates to an ink-jet recording sheet, more specifically, to an ink-jet recording sheet which causes no crack at the surface of an ink-receptive layer, and excellent in water fastness, light fastness, ink absorption property and glossiness.

2. Prior Art

As a recording sheet to be used for an ink-jet recording, a recording sheet which comprises, on a support such as a usual paper or the so-called ink-jet recording sheet, a porous ink absorption layer containing a pigment such as silica fine particles, and a hydrophilic binder such as polyvinyl alcohol has been known.

There have been proposed recording sheets obtained by coating silica fine particles and a hydrophilic binder onto a paper support as disclosed in, for example, Japanese Provisional Patent Publications No. 51583/1980, No. 157/1981, No. 107879/1982, No.107880/1982, No. 230787/1984, No.160277/1987, No.184879/1987, No. 183382/1987, No. 11877/1989, and the like. These recording sheets are poor in water fastness, image quality and surface gloss since they comprise a combination of a pigment and a binder.

Also, in Japanese Patent Publication No. 56552/1991, Japanese Provisional Patent Publications No. 188287/1990, No. 81064/1998, No. 119423/1998, No. 175365/1998, No. 203006/1998, No. 217601/1998, No.20300/1999, No.20306/1999 and No.24481/1999, there have been disclosed ink-jet recording sheets using synthetic silica fine particles prepared by a gas phase process (hereinafter referred to as "fumed silica"). The fumed silica is ultrafine particles having an average particle size of a primary particle of several nm to several tens nm, and has characteristics of easily giving high gloss.

As a support for the above-mentioned recording sheet, paper has conventionally been used in general and the paper itself had a role as an ink absorption layer. In recent years, a recording sheet having characteristics like photography has earnestly been desired. However, a recording sheet using paper as a support has problems of gloss, the feel of a material, water fastness, cockling (wrinkle or surface waviness) and the like. Thus, a water-resistant support such as a plastic resin film including a polyethylene film, or a polyolefin-coated paper in which a polyolefin resin such as polyethylene is laminated on the both surfaces of paper has now been used. However, these water-resistant supports cannot absorb ink which are differ from a paper support so that it is important that an ink-receptive layer provided on the support has a high ink absorption property. Accordingly, to prepare a recording sheet using a water-resistant support, a much amount of a pigment should be coated on the support as compared with that of a recording sheet using a paper support. When the content of the pigment is increased, surface crack (craze) is likely caused at the time of drying an ink-receptive layer after coating whereby the quality of the sheet is markedly lowered.

Occurrence of surface crack is likely caused when the primary average particle size is much smaller, and it is more likely caused in the fumed silica mentioned above. Also, to obtain high absorption property of ink, it is preferred to decrease a ratio of the content of a hydrophilic binder based on the content of silica fine particles. Thus, if the content of the hydrophilic binder is increased, surface crack is more likely caused.

Also, for the recording sheet, high levels of water fastness and light fastness are required. However, the above-mentioned conventional recording sheets did not sufficiently satisfy these required characteristics. Here, the water fastness means that ink of a recording image is not blurred or dissolved out when the recording sheet after printing is brought into contact with water or allowed to stand under highly humid conditions. The light fastness means that an image does not fade away when the recording sheet after printing is exposed to light.

As a method for improving water fastness, there has been known to use a water-soluble organic cationic polymer for fixing a water-soluble ink, as disclosed in, for example, Japanese Provisional Patent Publications No. 49990/1985, No. 83882/1985, No. 58788/1986, No. 174184/1987, No. 86508/1998, No. 193776/1998, and No. 217601/1998. However, there are problems that most of these water-soluble organic cationic polymers which improve the water fastness are always to make the light fastness worsen, while those which do not affect on the light fastness are always insufficient in water fastness. It is the present status that a water-soluble organic cationic polymer which can satisfy both of the water fastness and light fastness cannot be obtained as of today. Moreover, there is a problem that these water-soluble organic cationic polymers cause aggregation of silica fine particles easily when they are mixed with these silica fine particles so that coating property becomes worse and occurrence of surface crack or lowering in gloss are caused.

Also, as the other method for improving water fastness, it has been proposed to use polyaluminum hydroxychloride in, for example, Japanese Provisional Patent Publications No. 257286/1985, No. 16884/1986, etc., to use zirconium in Japanese Provisional Patent Publication No. 32046/1994, or to use an element of Group 4 of the Periodic Table in Japanese Provisional Patent Publications No.258567/1998, No. 309862/1998, etc. By using these compounds, a certain extent of an improvement has been admitted in water fastness, but the above-mentioned ink-jet recording sheets are not satisfied in gloss and ink absorption property.

Also, in a recording sheet using silica fine particles having a primary average particle size of 20 nm or less, there is a problem that the recording sheet is warped at the time of handling, crack is likely caused at the surface thereof so that improvement has been desired.

In a recording sheet which is an object of the present invention, there is a problem that a recorded image is likely fade away by a minute amount of gases which cause bad effects such as ozone, etc. existing in air when it is exposed to air. In particular, ultrafine particulate silica having a primary average particle size of 20 nm or less has a large specific surface area so that a surface area which is in contact with air becomes large whereby it is likely damaged by a minute amount of gas. Moreover, as mentioned above, by decreasing an amount of a hydrophilic binder to heighten ink absorption property, the silica is suffered from a bad effect caused by a minute amount of gas. Thus, it has also earnestly been desired to overcome this problem.

SUMMARY OF THE INVENTION

An object of the present invention is to provide an ink-jet recording sheet which has no surface defect such as surface cracking, etc., and has high gloss, excellent water fastness, light fastness and ink absorption property simultaneously. Another object of the present invention is to provide an ink-jet recording sheet which causes no surface crack at the time of operation. Still another object of the present invention is to provide an ink-jet recording sheet which can prevent from fading due to a minute amount of gas in air.

The above objects of the present invention have been achieved by an ink-jet recording sheet which comprises a support and at least one ink-receptive layer provided on the support, wherein at least one of the ink-receptive layer contains silica fine particles having an average primary particle diameter of 20 nm or less and at least one water-soluble polyvalent metal compound.

DESCRIPTION OF THE PREFERRED EMBODIMENTS

In the following, the embodiments of the present invention are explained in detail.

By using silica fine particles having an average primary particle diameter of 20 nm or less, high gloss and high ink absorption property can be obtained, but use of the same involved the problems of surface cracking at drying after coating, water fastness and light fastness of printed images. The present inventors have found that these problems can be solved by adding at least one water-soluble polyvalent metal compound.

In synthesized silica, there are two types of materials, one (precipitated silica) of which is prepared by the wet process and the other (fumed silica) is prepared by the gas phase process. Usual silica fine particles mean those prepared by the wet process in many cases. As the silica prepared by the wet process, there are (1) a silica sol obtained by metathesis of sodium silicate by an acid or passing through an ion exchange resin layer; (2) a colloidal silica obtained by heating and maturing the silica sol of (1); (3) a silica gel obtained by gelling silica sol in which formation conditions thereof are changed whereby primary particles of a silica gel having a diameter of several microns to 10 microns are agglomerated to form three-dimensional secondary particles; and (4) a synthetic silicic acid compound mainly comprising silicic acid obtained by heating silica sol, sodium silicate, sodium aluminate, etc.

A gas phase method for preparing fumed silica is also called to as the drying method contrary to the wet method, and the fumed silica can be generally prepared by a flame hydrolysis method. More specifically, it has been known a method in which silicon tetrachloride is burned with hydrogen and oxygen. In this method, silanes such as methyl trichlorosilane, trichloro-silane, etc., maybe used alone in place of silicon tetrachloride or in combination of silicone tetrachloride. The fumed silica is commercially available from Nippon Aerosil K.K. (Japan), K.K. Tokuyama (Japan), etc.

In the present invention, it is preferred to use fumed silica having an average primary particle size of 20 nm or less, more preferably having a specific surface area measured by the BET (Brunauer-Emmett-Teller) method of 200 $m^2/g$ or more, particularly preferably having an average primary particle size of 3 to 10 nm and a specific surface area measured by the BET method of 250 to 500 $m^2/g$ or more. The BET method herein mentioned means one of a method for measuring surface area of powder material by a gas phase adsorption method and is a method of obtaining a total surface area possessed by 1 g of a sample, i.e., a specific surface area, from an adsorption isotherm. As an adsorption gas, a nitrogen gas has frequently been used, and a method of measuring an adsorption amount obtained by the change in pressure or a volume of a gas to be adsorbed has most frequently been used. Most frequently used equation for representing isotherm of polymolecular adsorption is a Brunauer-Emmett-Teller equation which is also called to as a BET equation and has widely been used for determining a surface area of a substance to be examined. A specific surface area can be obtained by measuring an adsorption amount based on the BET equation and multiplying the amount with a surface area occupied by the surface of one adsorbed molecule.

The characteristic feature of the fumed silica to be preferably used in the present invention resides in that it exists in secondary particles in which primary particles are joined in a network structure or chain-like structure to form flocculate whereby a higher ink-absorption property can be obtained. It is preferred to maintain the state of the above-mentioned secondary particles in an average diameter of 50 to 500 nm or so whereby a higher ink-absorption property can be obtained without lowering gloss.

An amount of the silica fine particles to be contained in the ink-receptive layer in the present invention is preferably in the range of 8 $g/m^2$ or more, more preferably 10 $g/m^2$ or more, and further preferably in the range of 13 to 30 $g/m^2$. The ink-receptive layer containing silica fine particles preferably contains a hydrophilic binder to maintain the characteristic as a film.

As the hydrophilic binder, there may be used various known hydrophilic binders. There may be mentioned, for example, gelatin or its derivatives, polyvinyl pyrrolidone, pullulan, polyvinyl alcohol or its derivatives, polyethylene glycol, carboxymethyl cellulose, hydroxyethyl cellulose, dextrane, dextrin, polyacrylic acid or its salt, agar, carrageenan, xanthan gum, locust bean gum, alginic acid, gum arabic, polyalkyleneoxide copolymers disclosed in Japanese Provisional Patent Publications No. 197826/1995 and No. 9757/1995, a water-soluble polyvinyl butyral, or a homopolymer or a copolymer of a vinyl monomer having a carboxy group or a sulfonic acid group disclosed in Japanese Provisional Patent Publication No. 245260/1987, and the like.

Among the hydrophilic binders as mentioned above, polyvinyl alcohol and cation-modified polyvinyl alcohol are preferably used. Particularly preferred is partially or completely saponified polyvinyl alcohol having a saponification degree of 80% or more. It is also preferred that the polyvinyl alcohol has an average polymerization degree of 500 to 5000.

As the cation-modified polyvinyl alcohol, there may be mentioned a polyvinyl alcohol having a primary to tertiary amino group or a quaternary ammonium group at the main chain or the side chain thereof as disclosed in Japanese Provisional Patent Publication No. 10483/1986.

An amount of the hydrophilic binder is preferably a small ratio relative to the silica fine particles since in such a case, a high ink-absorptive property can be obtained. The hydrophilic binder is added in an amount of 50% by weight or less, preferably in the range of 1 to 30% by weight, more preferably 10 to 30% by weight based on the amount of the silica fine particles.

As explained above, when the content of silica fine particles is increased and the ratio of the hydrophilic binder to the silica fine particles is made small, surface crack will likely occur at the time of drying after coating. Such a problem can be resolved in the present invention by using a water-soluble polyvalent metal compound. These compounds improve water fastness and light fastness of a print after recording.

Among the above-mentioned water-soluble polyvalent metal compound, a water-soluble aluminum compound or a water-soluble compound containing an element of Group 4 of the Periodic Table is preferred in the present invention.

The water-soluble aluminum compound to be used in the present invention is not specifically limited so long as it is water-soluble, and it has been known water-soluble aluminum compounds such as inorganic aluminum compounds including aluminum chloride and its hydrates, aluminum sulfate and its hydrates, aluminum alum, etc., and further, polyaluminum hydroxychloride which is an inorganic aluminum-containing cationic polymer.

The above-mentioned polyaluminum hydroxychloride comprises as its main component those represented by the following formulae (1) to (3) and may include a water-soluble poly(aluminum hydroxide) containing a polynuclear condensed ion which is basic in a stable form, such as $[Al_6(OH)_{15}]^{3+}$, $[Al_8(OH)_{20}]^{4+}$, $[Al_{13}(OH)_{34}]^{5+}$, $[Al_{21}(OH)_{60}]^{3+}$, etc.

$$[Al_2(OH)_nCl_{6-n}]_m \quad (1)$$

$$[Al(OH)_3]_nAlCl_3 \quad (2)$$

$$Al_n(OH)_mCl_{(3n-m)} 0<m<3n \quad (3)$$

These water-soluble aluminum compounds are commercially available from Taki Chemical, K.K., Japan under the name of poly(aluminum chloride) (PAC, trade name) as a water treatment agent, from Asada Chemical K.K., Japan under the name of poly(aluminum hydroxide) (Paho, trade name), from K. K. Riken Green, Japan under the name of Pyurakemu WT (trade name) and other manufacturers with the same objects whereby various kinds of different grade can be easily obtained.

The water-soluble compound containing an element of Group 4 of the Periodic Table to be used in the present invention is not specifically limited so long as it is water-soluble, and a water-soluble compound containing titanium and/or zirconium is preferred. As the water-soluble compound containing titanium, there may be mentioned, for example, titanium chloride, titanium sulfate, etc. As the water-soluble compound containing zirconium, there may be mentioned, for example, zirconium acetate, zirconium chloride, zirconium oxychloride, zirconium hydroxychloride, zirconium nitrate, basic zirconium carbonate, zirconium hydroxide, zirconium lactate, zirconium ammonium carbonate, zirconium potassium carbonate, zirconium sulfate, zirconium fluoride compound, etc. In the present specification, the term "water-soluble" means that the compound is dissolved in water in an amount of 1% by weight or more at normal temperature and normal pressure.

The content of the above-mentioned water-soluble aluminum compound and/or the water-soluble compound containing an element of Group 4 of the Periodic Table in the ink-receptive layer is preferably 0.1 to 10 g/m$^2$, more preferably 0.2 to 5 g/m$^2$.

In the present invention, as a method of adding the water-soluble aluminum compound and/or the water-soluble compound containing an element of Group 4 of the Periodic Table to the ink-receptive layer, it is not specifically limited. There may be mentioned, for example, a method in which it is added to silica fine particles at the time of dispersion thereof, and then, mixing with a hydrophilic binder to prepare a coating solution; or a method in which it is added to an ink-receptive layer forming solution at the final stage of preparation thereof. It is preferred to determine the timing of adding the water-soluble aluminum compound and/or the water-soluble compound containing an element of Group 4 of the Periodic Table to an ink-receptive layer coating solution in view of the stability of the coating solution.

In the present invention, it is preferred to use a cross-linking agent (or a hardening agent) in the ink-receptive layer in combination with the hydrophilic binder. Specific examples of the cross-linking agent may include an aldehyde series compound such formaldehyde, glutaraldehyde, etc.; a ketone compound such as diacetyl, chloropentadione, etc.; bis(2-chloroethyl-urea)-2-hydroxy-4,6-dichloro-1,3,5-triazine, a compound having a reactive halogen as disclosed in U.S. Pat. No. 3,288,775, divinylsulfone, a compound having a reactive olefin as disclosed in U.S. Pat. No. 3,635,718, a N-methylol compound as disclosed in U.S. Pat. No. 2,732,316, an isocyanate compound as disclosed in U.S. Pat. No. 3,103,437, anaziridine compound as disclosed in U.S. Pat. Nos. 3,017,280, 2,983,611, etc., a carbodiimide series compound as disclosed in U.S. Pat. No. 3,100,704, an epoxy compound as disclosed in U.S. Pat. No. 3,091,537, a halogen carboxyaldehyde compound such as mucochloric acid, a dioxane derivative such as dihydroxydioxane, an inorganic cross-linking agent such as chromium alum, zirconium sulfate, boric acid and a borate, and they may be used singly or in combination of two or more. Of these, boric acid or a borate is particularly preferred. By further adding boric acid or a borate to the components constituting the ink-receptive layer of the present invention, effects of preventing from crack, blurring under high humidity and peeling of surface can be improved.

The above-mentioned cross-linking agent may be used in an amount of 0.01 to 40% by weight, particularly preferably in the range of 0.1 to 30% by weight based on the amount of the hydrophilic binder.

In the present invention, an organic cationic polymer may be further added to the ink-receptive layer. As the organic cationic polymers which can be used in the present invention, there may be mentioned cationic polymers such as a poly-diallylamine derivative cationic polymer, a poly-dicyanediamide derivative, polyalkylene polyamine derivative, a polyamine derivative wherein quaternary degree of which is 30% or more, more preferably 50% or more. By using the organic cationic polymer, water fastness such as blurring under high humidity of the ink-receptive layer can be more improved. A weight average molecular weight (Mw) of the cationic polymer is preferably 5,000 or more, more preferably 5,000 to 100,000 or so.

The ink-receptive layer of the present invention may further contain various kinds of oil drops to improve brittleness of the film. As such oil drops, a hydrophobic organic solvent having a high boiling point and a solubility in water at room temperature of 0.01% by weight or less (e.g., liquid paraffin, dioctyl phthalate, tricresyl phosphate, silicone oil, etc.), polymer particles (e.g., particles obtained by polymerizing at least one of polymerizable monomers such as styrene, butyl acrylate, divinylbenzene, butyl methacrylate, hydroxyethyl methacrylate, etc.) or the like may be used. The above-mentioned oil drops can be preferably used in an amount in the range of 10 to 50% by weight.

To the ink-receptive layer of the present invention, a surfactant may be added. As such surfactants, there may be preferably mentioned a cationic surfactant, a nonionic surfactant, a betaine type surfactant and the like. The surfactant maybe a low molecular weight or high molecular weight surfactant. An amount of the surfactant to be added may preferably be 0.001 to 5% by weight, more preferably 0.01 to 3% by weight based on the hydrophilic binder constituting the ink-receptive layer.

In the present invention, it is preferred that the ink-receptive layer contains at least one selected from the group consisting of a nitrite, a sulfite, a bisulfite, a phosphite, a thio-phosphate, and a compound represented by the following formula (I):

(I)

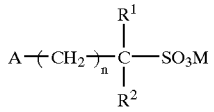

wherein A represents a hydroxyl group or an amino group which may be substituted by an unsubstituted or substituted alkyl group having 1 to 4 carbon atoms, or an unsubstituted or substituted aryl group; $R^1$ and $R^2$ are combined to form a 5- or 6-membered ring with the carbon atom to which they are bonded, or one of which represents a hydrogen atom and the other represents a hydrogen atom, an alkyl group having 1 to 17 carbon atoms, an aryl group which may be substituted by at least one of a hydroxyl group or $-SO_3M$, or a group represented by the following formula (II); n represents 0 or an integer of 1 to 8; and M represents a cation, (II)

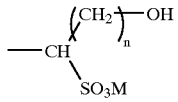

where n and M have the same meaning as defined above. By adding the compound as mentioned above, fading by a minute amount of a gas can be prevented when the printed recording medium is exposed in air.

The compound represented by the above-mentioned formula (I) is explained in detail below. The amino group in the formula (I) includes an unsubstituted and substituted amino group. As the substituent for the amino group, there may be mentioned, for example, an alkyl group having 1 to 4 carbon atoms (e.g., a methyl group, an ethyl group, an isopropyl group, etc.), a substituted alkyl group having 1 to 4 carbon atoms (e.g., a hydroxyethyl group, an aminoethyl group, etc.), an aryl group (e.g., a phenyl group, a naphthyl group, etc.), a substituted phenyl group (e.g., a 3-aminophenyl group, a 4-chlorophenyl group, etc.) and the like. The cation M in the formula (I) may include a hydrogen, an alkali metal such as sodium, potassium, etc., and an ammonium group. Specific examples of the compound represented by the above-mentioned formula (I) are shown below.

(I-1)

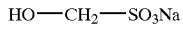

(I-2)

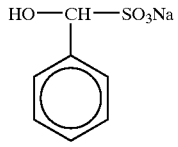

(I-3)

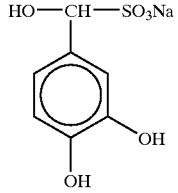

-continued (I-4)

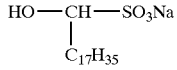

(I-5)

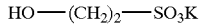

(I-6)

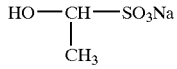

(I-7)

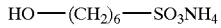

(I-8)

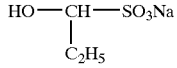

(I-9)

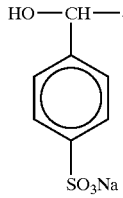

(I-10)

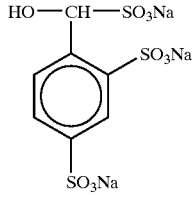

(I-11)

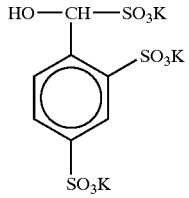

(I-12)

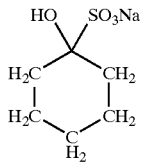

(I-13)

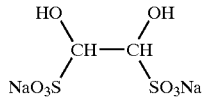

(I-14)

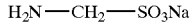

(I-15)

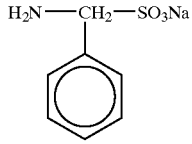

-continued (I-16)

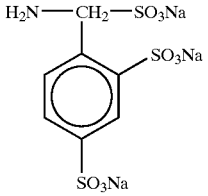

(I-17)

$C_2H_5NHCH_2CH_2SO_3Na$ (I-18)

$HOC_2H_4NHCH_2CH_2SO_3Na$ (I-19)

$(CH_3)_2NCH_2CH_2SO_3Na$ (I-20)

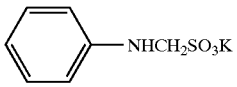

As the nitrite, the sulfite, the bisulfite, the phosphite or the thiophosphate to be used in the present invention, those conventionally known and commercially available materials may be used. As a cation of these acids, there may be mentioned a metal ion of an alkali metal such as lithium, sodium, potassium, etc., a transition metal such as zinc, copper, nickel, etc., or an ammonium ion. As the phosphite, there may be also mentioned sodium phosphite, disodium hydrogen phosphite, calcium phosphite, etc. These compounds may be used singly or in combination of two or more.

An amount of the above-mentioned compound represented by the formula (I), the nitrite, the sulfite, the bisulfite, the phosphite and/or the thiophosphate may be preferably 0.001 to 10 g/m$^2$, more preferably 0.01 to 5 g/m$^2$ based on the ink-receptive layer.

In the present invention, it is preferred to contain polyvinyl alcohol and a water-soluble plasticizer of said polyvinyl alcohol in combination in the ink-receptive layer. By having such a constitution, occurrence of surface crack by folding of a recording sheet at the time of handling can be prevented.

As the water-soluble plasticizer of the polyvinyl alcohol, there may include those which have a plasticizing effect on the polyvinyl alcohol as disclosed in "POVAL", written by Koichi Nagano, et al., published on Apr. 10, 1970, Kobunshi Kankokai, Japan, pp. 155–161. Here, the term "water-soluble" means a material which dissolves in pure water in an amount of 1% by weight or more at 25° C. Specific examples of the water-soluble plasticizer may include, for example, glycols such as ethylene glycol, diethylene glycol, triethylene glycol, propylene glycol, dipropylene glycol, polyethylene glycol, polypropylene glycol, etc.; glycerin, diglycerin, butanediol, trimethylolpropane, triethanolamine, ethanol acetamide, urea and its derivatives (for example, those as described in Japanese Provisional Patent Publication No. 184096/1999), a mono-saccharide such as sorbitol, etc. Of these, glycerin and urea are particularly effective for preventing from causing surface crack at the time of folding the recording sheet.

An amount of the water-soluble plasticizer is preferably 1 to 30% by weight, more preferably 2 to 20% by weight based on the amount of the polyvinyl alcohol.

In the present invention, to the ink-receptive layer may be added, in addition to the surfactant and cross-linking agent, various kinds of conventionally known additives such as a coloring dye, a coloring pigment, a fixing agent of the ink dye, an UV absorber, an antioxidant, a dispersant of the pigment, a defoaming agent, a leveling agent, an antiseptic agent, a fluorescent brightener, a viscosity stabilizer, a pH controller, etc.

In the present invention, the ink-receptive layer containing silica fine particles preferably has a surface pH of 3 to 5. The surface pH of the ink-receptive layer is a surface pH obtained by dropping distilled water on the surface of the ink-receptive layer and measuring the pH at the distilled water portion after 30 seconds from dropping according to the method of J. TAPPI paper pulp testing method No. 49.

As a method for adjusting the surface pH, there may be mentioned (1) a method in which a pH of a coating solution for preparing an ink-receptive layer is preliminary set to a determined value and a pH of the coated layer is made a desired value;

(2) a method in which a solution having a suitable pH is overcoated on the ink-receptive layer after coating and drying, and dried to obtain a desired pH; and (3) a method in which after coating and drying the ink-receptive layer, the recording sheet is immersed in an aqueous solution having a suitable pH and dried, etc.

Among the above-mentioned methods (1) to (3), the method of (1) is preferred since it is simple in procedure. That is, it is preferred to adjust the pH at the time of preparing a coating solution of the ink-receptive layer. In this case, a pH of the coating solution for preparing the ink-receptive layer and a pH of the surface of the ink-receptive layer after coating and drying do not necessarily coincide with each other. Thus, it would be necessary to previously identify the relationship between the pH of the coating solution for preparing the ink-receptive layer and the pH of the surface of the ink-receptive layer after coating and drying by preliminary experiments. A pH adjustment of the coating solution for preparing the ink-receptive layer can be carried out by using an acid or an alkali in a suitable combination. As the acid, there may be used an inorganic acid such as hydrochloric acid, nitric acid, sulfuric acid, phosphoric acid, etc., and an organic acid such as acetic acid, citric acid, succinic acid, etc., while as an alkali, there may be used sodium hydroxide, aqueous ammonia, potassium carbonate, trisodium phosphate, or an alkali metal salt of a weak acid as a weak alkali. As the above-mentioned alkali metal salt of the weak acid, preferred are salts of a volatile acid such as acetic acid, carbonic acid, hydrogen carbonate, formic acid, propionic acid, etc., and an alkali metal such as sodium, potassium, lithium, etc.

In the present invention, the ink-receptive layer may be single layer or a plural layer of two or more, and a coating method thereof is not particularly limited, and a coating method conventionally known in the art may be used. For example, there may be mentioned a slide bead system, a curtain system, an extrusion system, an air knife system, a roll coating system, a rod bar coating system, etc.

The ink-receptive layer coated on a support is dried in a drying step, and, it is preferred in the present invention to effect drying of the ink-receptive layer at an air temperature for drying of 60° C. or lower. Moreover, it is further preferred to cool the ink-receptive layer-coated support in an atmosphere of 20° C. or lower, more preferably 15° C. or lower immediately after coating the ink-receptive layer for 10 seconds or more. Furthermore, it is preferred to dry the ink-receptive layer from the solid content of 95% by weight to the completion of the drying in air with a relative humidity (RH) of 20 to 60%, more preferably under 25 to 50% RH, most preferably under 25 to 45% RH. The above-mentioned drying conditions have an effect of preventing from occurring surface crack at the time of drying of the ink-receptive layer.

As the support to be used in the present invention, a water resistant support is preferred, and a polyolefin resin-coated paper in which paper is covered (or laminated) by a polyolefin resin such as polyethylene or polypropylene, etc., is preferably used. A thickness of the water resistant support to be used in the present invention is preferably about 50 to 300 μm or so. In the following, the polyolefin resin-coated paper will be explained in detail.

A base paper constituting the polyolefin resin-coated paper is not particularly limited, and any paper generally used may be employed. More preferably a smooth base paper such as that used as paper for a photographic support may be used. As pulp constituting the base paper, natural pulp, regenerated pulp, synthetic pulp, etc. may be used singly or in combination of two or more. In the base paper, various additives conventionally used in the papermaking industry such as a sizing agent, a strengthening additive of paper, a loading material, an antistatic agent, a fluorescent brightener, a dye, etc. may be formulated.

Moreover, a surface sizing agent, a surface strengthening additive of paper, a fluorescent brightener, an antistatic agent, a dye, an anchoring agent, etc. may be coated on the surface of the sheet.

A thickness of the base paper is not particularly limited, and preferably that having a good surface smoothness prepared by compressing paper during paper-making or after paper-making by applying pressure using a calender, etc. A basis weight thereof is preferably 30 to 250 g/m$^2$.

As a resin of the polyolefin resin-coated paper, a polyolefin resin or a resin which cures by irradiation of electron rays may be used. The polyolefin resin may include a homopolymer of an olefin such as low density polyethylene, high density polyethylene, polypropylene, polybutene, polypentene, etc.; a copolymer comprising two or more olefins such as an ethylene-propylene copolymer, etc.; or a mixture thereof, and these polymers having various densities and melt viscosity indexes may be used singly or in combination of two or more.

Also, to the resin of the polyolefin resin-coated paper, various kinds of additives including a white pigment such as titanium oxide, zinc oxide, talc, calcium carbonate, etc.; an aliphatic amide such as stearic amide, arachidamide, etc.; an aliphatic metal salt such as zinc stearate, calcium stearate, aluminum stearate, magnesium stearate, etc.; an antioxidant such as Irganox 1010, Irganox 1076 (both trade names, available from Ciba Geigy AG), etc.; a blue-color pigment or dye such as cobalt blue, ultramarine blue, cecilian blue, phthalocyanine blue, etc,; a magenta-color pigment or dye such as cobalt violet, fast violet, manganese violet, etc.; a fluorescent brightener, an UV absorber, etc. may be preferably added optionally combining two or more.

The polyolefin resin-coated paper can be prepared, in the case of using a polyolefin resin, by casting a melted resin under heating on a running base paper, which is so-called the extrusion coating method, whereby the both surfaces of the base paper are coated by the resin. In the case of using a resin which cures by irradiation of electronic rays, the resin is coated on a base paper by means of a coater conventionally used such as a gravure coater, a blade coater, etc., then, electronic rays are irradiated to the resin whereby coating the base paper with the resin. Also, it is preferred to subject an activation treatment to a base paper before coating the resin to the base paper, such as a corona discharge treatment, a flame treatment, etc. It is not necessarily subjected to resin coating at the back surface of the base paper, but in view of preventing curl, it is preferred to coat the both surfaces of the base paper with the resin. The activation treatment such as the corona discharge treatment, the flame treatment, etc. may be applied to the front surface or to the both surfaces of the front and back surfaces depending on the necessity. Also, a thickness of the resin layer is not particularly limited, and is generally in the range of 5 to 50 μm on the front surface or both of the front and back surfaces.

To the support of the present invention, various kinds of back coating layer(s) may be provided for the purpose of providing antistatic property, conveying property, anticurl property, etc. to the support. In the back coating layer, an inorganic antistatic agent, an organic antistatic agent, a hydrophilic binder, a latex, a curing agent, a pigment, a surfactant, etc. may be included in optional combination.

EXAMPLES

The present invention is described in detail by referring to Examples, but the scope of the present invention is not limited by these.

Example 1

On the front surface of a base paper comprising a pulp formulation of LBKP (50 parts) and LBSP (50 parts) with 120 g/m$^2$ as a support was coated a resin composition comprising a low density polyethylene (70 parts), a high density polyethylene (20 parts) and titanium oxide (10 parts) in an amount of 25 g/m$^2$, and a resin composition comprising a high density polyethylene (50 parts) and a low density polyethylene (50 parts) was coated on the back surface of the same in an amount of 25 g/m$^2$ to prepare a polyolefin resin coated paper.

On the above-mentioned support was coated an ink-receptive layer coating solution having a composition as mentioned below and dried to prepare a recording sheet. A coating amount of silica fine particles is made with a solid component of 15 g/m$^2$. A coating solution for preparing the ink-receptive layer was prepared by dispersing silica fine particles (10 % by weight of the whole weight) in a dispersing medium of water:ethyl alcohol=20:1 using a high-pressure homogenizer, then, Compound A shown in Table 1, boric acid, polyvinyl alcohol, and a surfactant were added to the dispersion to prepare a coating solution. Total solid concentration of the above coating solution was 10% by weight. After allowing the coating solution for 2 hours at room temperature, it was coated. Incidentally, all "part" means parts by weight of a solid component.

Coating solution for preparing an ink-receptive layer

| | |
|---|---|
| Silica fine particles | 100 parts by weight |
| Compound A (shown in Table 1) | 4 parts by weight |
| Boric acid | 3 parts by weight |
| Polyvinyl alcohol (PVA235, trade name, available from Kuraray, Saponification degree of 88%, an average polymerization degree of 3500) | 20 parts by weight |
| Ampholytic surfactant (SWAM AM-2150, trade name, available from Nippon Surfactant K.K) | 0.3 part by weight |

By changing the kind of the silica fine particles and Compound A as shown in Table 1, various kinds of recording sheets were prepared. Incidentally, when preparing the above-mentioned coating solution, it was so adjusted that a surface pH of the ink-receptive layer after drying became 4±0.5.

Drying conditions after coating of the coating solution for preparing an ink-receptive layer were set as mentioned below.

That is, after coating, the coated material was immediately cooled in an atmosphere of 10° C. for 20 seconds, dried at 50° C. under a relative humidity of 10% until the solid concentration of the coated ink-receptive layer reaches to 95% by weight, and dried at 35° C. under a relative humidity of 40% during the solid concentration of the same of 95% by weight to completion of the drying.

TABLE 1

| Recording sheet | Silica fine particles | Compound A | Remarks |
|---|---|---|---|
| 1 | Fumed silica 1 | Basic poly(aluminum hydroxide) 1 | Present invention |
| 2 | Fumed silica 2 | Basic poly(aluminum hydroxide) 1 | Present invention |
| 3 | Fumed silica 3 | Basic poly(aluminum hydroxide) 1 | Present invention |
| 4 | Fumed silica 1 | Basic poly(aluminum hydroxide) 2 | Present invention |
| 5 | Fumed silica 1 | Aluminum chloride | Present invention |
| 6 | Fumed silica 1 | Titanium chloride | Present invention |
| 7 | Fumed silica 1 | Zirconium oxychloride | Present invention |
| 8 | Fumed silica 1 | Zirconium nitrate | Present invention |
| 9 | Fumed silica 1 | Zirconium hydroxychloride | Present invention |
| 10 | Fumed silica 1 | None | Comparative |
| 11 | Fumed silica 1 | Water-insoluble aluminum hydroxide | Comparative |
| 12 | Fumed silica 1 | Polymer of the following formula | Comparative |
| 13 | Fumed silica 1 | Alkylamine epichlorohydrin polycondensate | Comparative |

Fumed silica 1: Aerosil 380, trade name, available from Nippon 5 Aerosil K.K., Japan, average primary particle size: 7 nm, Specific surface area according to the BET method:

380 $m^2/g$.

Fumed silica 2: Aerosil 200V, trade name, available from Nippon Aerosil K.K., Japan, average primary particle size: 12 nm, Specific surface area according to the BET method:

200 $m^2/g$.

Fumed silica 3: Aerosil 90G, trade name, available from Nippon Aerosil K.K., Japan, average primary particle size: 20 nm, Specific surface area according to the BET method: 90 $m^2/g$.

Basic poly(aluminum hydroxide) 1: Pyurakemu WT, trade name, available from K.K. Riken Green, Japan.

Basic poly(aluminum hydroxide) 2: PAC300M, trade name, available from Taki Kagaku K.K., Japan.

Zirconium oxychloride: available from Nippon Keikinzoku K.K., Japan

Zirconium nitrate: available from Nippon Keikinzoku K.K., Japan.

Zirconium hydroxychloride: available from Nippon Keikinzoku K.K., Japan.

Water-insoluble aluminum hydroxide: hydilight H-42M (added to a coating solution as a 10% by weight aqueous dispersion), available from Showa Denko K.K., Japan.

Alkylamine epichlorohydrin polycondensate: Jet-Fix 3, available from Satoda Kako K.K., Japan.

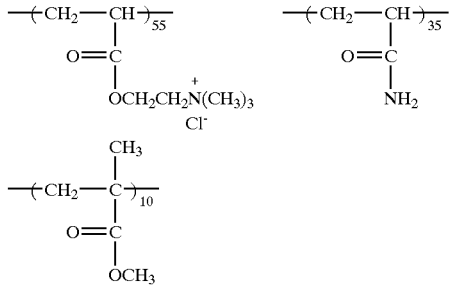

With respect to the above-mentioned 13 kinds of ink-jet recording sheets, the following evaluations were carried out. Incidentally, for effecting ink-jet recording, printing was carried out by using PM-770C color printer (trade name, available from Seiko Epson Co., Japan) at normal temperature and normal humidity. The results are shown in Table 2.

(Glossiness)

Gloss at the surface of an ink-jet recording sheet before printing was judged with naked eyes and evaluated by the following four ranks.

◎ Gloss is extremely high and good.

○ Gloss is high but slightly inferior to ◎.

Δ: Gloss is slightly inferior to ○.

X: Gloss is low.

(Surface crack)

Presence or absence of cracks at the surface of an ink-jet recording sheet before printing was judged with naked eyes and evaluated by the following three ranks.

○: No crack was observed.

Δ: Crack was slightly admitted.

X: Crack was admitted on the whole surface.

(Ink absorption property)

Whole surface was solid printed by red-color ink, and a PPC paper was overlapped with the ink-jet recording sheet with slightly pressurizing immediately after printing, and the degree of an amount of the ink attached to the PPC paper was observed with naked eyes and evaluated by the following standard.

○: No transfer was observed.

Δ: Transfer was slightly admitted.

X: Transfer was admitted remarkably.

(Water fastness)

An ink-jet recording sheet in which it was printed with red-color letters on the surface thereof the whole surfaces of which had been solid printed by black-color ink was tested according to the following two conditions, and blurring of an image was evaluated by the following standard.

① The recording sheet was dipped in flowing water at 20° C. for one minute.

② The recording sheet was allowed to stand in atmosphere at 35° C. and 90% relative humidity for 2 days.

○: No blurring was observed under both of the above conditions.

Δ: Blurring was slightly admitted in either of the conditions.

X: Blurring was admitted remarkably under the both of the above conditions.

(Light fastness)

Solid printing with a single color of C (cyan), M (magenta), Y (yellow) or K (black) was each carried out with the maximum density, and optical densities of the respective colors were measured by a reflective densitometer (SPECTROLINO, trade name, available from GRETAG Co.), respectively. The samples densities of which had been measured were allowed to stand under fluorescent light (illuminance: 10,000 lux) for a week, and then, the optical densities of the respective colors were again measured and the maximum density differences of the samples were measured. When the difference in the density becomes larger, it shows that fading due to light becomes remarkable, in other words, the light fastness is poor.

TABLE 2

| Sample (Recording sheet) | Glossiness | Surface crack | Ink absorption property | Water resistance | Light resistance | Remarks |
|---|---|---|---|---|---|---|
| 1 | ◎ | ○ | ○ | ○ | 0.1> | This invention |
| 2 | ○~◎ | ○ | ○ | ○ | 0.1> | This invention |
| 3 | ○ | ○ | ○ | ○ | 0.1> | This invention |
| 4 | ◎ | ○ | ○ | ○ | 0.1> | This invention |
| 5 | ◎ | ○ | ○ | Δ | 0.1 | This invention |
| 6 | ◎ | ○ | ○ | ○ | 0.1 | This invention |
| 7 | ◎ | ○ | ○ | ○ | 0.1 | This invention |
| 8 | ◎ | ○ | ○ | ○ | 0.1 | This invention |
| 9 | ◎ | ○ | ○ | ○ | 0.1 | This invention |
| 10 | ○ | X | ○ | X | 0.1> | Comparative |
| 11 | X | X | ○ | X | 0.1> | Comparative |
| 12 | Δ~○ | X | ○ | Δ | 1.0 | Comparative |
| 13 | Δ | X | ○ | Δ | 0.9 | Comparative |

As can be clearly seen from the above results, in the ink-jet recording sheets of the present invention, all the characteristics such as water fastness, light fastness, glossiness, surface defects of surface crack, etc., and ink absorption property could be satisfied.

Incidentally, as an additional comparative example, an ink-jet recording sheet in which the fumed silica 1 in the above-mentioned ink-jet recording sheet was replaced with a fumed silica having an average primary particle size of 30 nm (Aerosil 50, trade name, available from Nippon Aerosil K.K., an average primary particle size: 30 nm, a specific surface area according to the BET method: 50 $m^2/g$) was prepared, but gloss thereof was markedly lowered so that a desired material required in the present invention could not be obtained.

Example 2

Respective Compounds B shown in Table 3 were each added to the coating solution for forming an ink-receptive layer of the ink-jet recording sheets 1 and 7 prepared in Example 1 in an amount of 3 parts by weight to prepare respective ink-jet recording sheets. With regard to these ink-jet recording sheets, their characteristics were evaluated in the same manner as in Example 1. As the results, each ink-jet recording sheet had the similar characteristics as those of the recording sheet 1 or 7 of Example 1. Moreover, with regard to these ink-jet recording sheets, a degree of fading due to the presence of a minute amount of a gas in air was evaluated according to the following test method. The results are shown in Table 3. Incidentally, the result of Recording sheet 10 is also described for the comparative purpose.

(Test method)

Recording by printing was carried out in the same manner as in the light fastness test of Example 1, and after exposing to air at room temperature for 3 months, the respective densities at the printed portion were measured and changes in density (the density after exposure/the density before exposure) were measured, respectively. Among the respective images of C, M, Y and K, the value most decreased in density (less numerical value) was shown.

TABLE 3

| Recording sheet | Ink-receptive layer | Compound B | Change in density after exposure in air (%) |
|---|---|---|---|
| 10 | Ink-receptive layer of Recording sheet 10 of Example 1 | None | 75 |
| 14 | Ink-receptive layer of Recording sheet 1 of Example 1 | None | 80 |
| 15 | | (I-1) | 90 |
| 16 | | (I-3) | 89 |
| 17 | | (I-14) | 91 |
| 18 | | (I-17) | 90 |
| 19 | | Sodium nitrite | 92 |
| 20 | | Sodium sulfite | 93 |
| 21 | | Sodium bisulfite | 92 |
| 22 | | Sodium hydrogen phosphite | 91 |
| 23 | | Sodium thiosulfate | 94 |
| 24 | Ink-receptive layer of Recording sheet 7 of Example 1 | None | 81 |
| 25 | | (I-1) | 91 |
| 26 | | (I-3) | 90 |
| 27 | | (I-14) | 91 |
| 28 | | (I-17) | 90 |
| 29 | | Sodium nitrite | 93 |
| 30 | | Sodium sulfite | 93 |
| 31 | | Sodium bisulfite | 92 |
| 32 | | Sodium hydrogen phosphite | 92 |
| 33 | | Sodium thiosulfate | 94 |

From the results in the above table, it can be understood that color fading when exposed in air can be restrained by further adding a compound of the formula (I), a nitrite, a sulfite, a bisulfite, a phosphite or a thiosulfate to the ink-receptive layer.

Example 3

Urea or glycerin was each added as Compound C to the coating solution for forming an ink-receptive layer of the ink-jet recording sheets 1 and 7 prepared in Example 1 in an amount of 1.4 parts by weight to prepare respective ink-jet recording sheets. With regard to these ink-jet recording sheets, their characteristics were evaluated in the same manner as in Example 1. As the results, each ink-jet recording sheet had the similar characteristics as those of the recording sheet 1 or 7 of Example 1. Moreover, with regard to these ink-jet recording sheets, a degree of generating cracks when the sheet had been bent was evaluated according to the following test method. The results are shown in Table 4. Incidentally, the result of Recording sheet 10 is also described for the comparative purpose.

(Test method)

An ink-jet recording sheet not yet printed was cut to a size of 2 cm×8cm, and when the sheet was bent with a printing surface upside to a longitudinal direction, a curvature radius at the time of generating cracks on the printing surface was measured. Incidentally, the smaller curvature radius means more excellent in preventing from causing cracks on the printing surface.

TABLE 4

| Recording sheet | Ink-receptive layer | Compound C | curvature radius at the time of generating cracks (mm) |
|---|---|---|---|
| 10 | Ink-receptive layer of Recording sheet 10 of Example 1 | None | 15 to 20 |
| 34 | Ink-receptive layer of Recording sheet 1 of Example 1 | None | 10 to 15 |
| 35 | | Urea | 0 to 6 |
| 36 | | Glycerin | 0 to 6 |
| 37 | Ink-receptive layer of Recording sheet 7 of Example 1 | None | 10 to 15 |
| 38 | | Urea | 0 to 6 |
| 39 | | Glycerin | 0 to 6 |

From the above results, it can be understood that by using polyvinyl alcohol which is a hydrophilic binder and its water-soluble plasticizer in combination, surface cracks at the time of handling can be restrained.

What is claimed is:

1. An ink-jet recording sheet which comprises a water resistant support and at least one ink-receptive layer provided on the support, wherein at least one of the ink-receptive layer contains fumed silica fine particles having an average primary particle diameter of 20 nm or less in an amount of 8 g/m$^2$ or more, a hydrophilic binder in an amount of 50% by weight or less based on the amount of the fumed silica and at least one water-soluble polyvalent metal compound selected from the group consisting of a basic polyaluminum hydroxide compound and a water-soluble compound containing an element selected from the group consisting of titanium and zirconium.

2. The ink-jet recording sheet according to claim 1, wherein the average primary particle diameter of the fumed silica is 20 nm or less and a specific surface area measured by the BET method is 200 m$^2$/g or more.

3. The ink-jet recording sheet according to claim 2, wherein the ink-receptive layer contains the fumed silica in an amount of 10 g/m$^2$ or more and a hydrophilic binder in an amount of 10 to 30% by weight based on the amount of the fumed silica.

4. The ink-jet recording sheet according to claim 1, wherein a pH of a surface of the ink-receptive layer is 3 to 5.

5. The ink-jet recording sheet according to claim 1, wherein the ink-receptive layer contains polyvinyl alcohol as a hydrophilic binder and further contains a water-soluble plasticizer of the polyvinyl alcohol.

6. The ink-jet recording sheet according to claim 5, wherein the water-soluble plasticizer is urea or glycerin.

7. The ink-jet recording sheet according to claim 1, wherein the ink-receptive layer contains at least one compound selected from the group consisting of a nitrite, a sulfite, a bisulfite, a phosphite, a thiosulfate and a compound represented by the following formula (I):

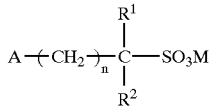

(I)

wherein A represents a hydroxyl group or an amino group which may be substituted by an unsubstituted or substituted alkyl group having 1 to 4 carbon atoms, or an unsubstituted or substituted aryl group; $R^1$ and $R^2$ are combined to form a 5- or 6-membered ring with the carbon atom to which they are bonded, or one of which represents a hydrogen atom and the other represents a hydrogen atom, an alkyl group having 1 to 17 carbon atoms, an aryl group which may be substituted by at least one of a hydroxyl group or $-SO_3M$, or a group represented by the following formula (II); n represents 0 or an integer of 1 to 8; and M represents a cation,

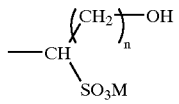

(II)

where n and M have the same meaning as defined above.

8. The ink-jet recording sheet according to claim 7, wherein the nitrate, the sulfite, the bisulfite, the phosphite or the thiosulfate is a salt of an alkali metal or ammonium.

9. The ink-jet recording sheet according to claim 1, wherein the water resistant support is a polyolefin resin-coated paper.

10. The ink-jet recording sheet according to claim 1, wherein the ink-receptive layer contains a hydrophilic binder and a cross-linking agent of the hydrophilic binder.

11. The ink-jet recording sheet according to claim 10, wherein the cross-linking agent is boric acid or a borate.

* * * * *